US005365245A

United States Patent [19]

Ho

[11] Patent Number: 5,365,245

[45] Date of Patent: Nov. 15, 1994

[54] HYBRID ORTHOGONAL TRANSVERSE ELECTROMAGNETIC FED REFLECTOR ANTENNA

[75] Inventor: Thinh Q. Ho, Anaheim, Calif.

[73] Assignee: The United States of America as represented by the Secretary of the Navy, Washington, D.C.

[21] Appl. No.: 61,611

[22] Filed: May 6, 1993

[51] Int. Cl.[5] ..... H01Q 19/12

[52] U.S. Cl. ..... 343/840; 343/909

[58] Field of Search ..... 343/840, 729, 730, 725, 343/767, 872, 873, 909; H01Q 19/12

[56] References Cited

U.S. PATENT DOCUMENTS

| | | | |
|---|---|---|---|
| 2,846,678 | 8/1958 | Best | 343/727 |
| 3,193,831 | 7/1965 | Yang | 343/792.5 |
| 3,611,393 | 10/1971 | Kibler | 343/761 |
| 4,095,230 | 6/1978 | Salmond et al. | 343/729 |
| 4,198,639 | 4/1980 | Killion | 343/727 |
| 4,348,677 | 9/1982 | Salmond | 343/729 |
| 4,544,928 | 10/1985 | Afifi et al. | 343/781 P |
| 4,786,915 | 11/1988 | Cartwright et al. | 343/909 |

FOREIGN PATENT DOCUMENTS

| | | | |
|---|---|---|---|
| 2523772 | 9/1983 | France | 343/729 |

OTHER PUBLICATIONS

Dent, "Skeleton Slot Aerial", Wireless World, Aug. 1954, pp. 399–401.

*Primary Examiner*—Donald Hajec
*Assistant Examiner*—Hoanganh Le
*Attorney, Agent, or Firm*—Harvey Fendelman; Thomas Glenn Keough; Michael A. Kagan

[57] ABSTRACT

A hybrid orthogonal transverse electromagnetic fed reflector antenna is disclosed which comprises an electromagnetic reflector; a transverse electromagnetic transmission carrier which includes a first electrically conductive strut having a first electrical impedance which is mounted in electrical contact with the reflector, and a second electrically conductive strut having a second electrical impedance substantially equal to the first electrical impedance, and which is mounted in electrical contact with the reflector; and a transverse electromagnetic feed having a first electrical conductor mounted in electrical contact with the first strut, and a second electrical conductor electrically isolated from the first electrical conductor and electrically coupled to the second strut.

17 Claims, 4 Drawing Sheets

HYBRID ORTHOGONAL TRANSVERSE ELECTROMAGNETIC FED REFLECTOR ANTENNA

The invention described herein may be manufactured and used by or for the Government of the United States of America for governmental purposes without the payment of any royalties thereon or therefor.

BACKGROUND OF THE INVENTION

The present invention relates to the field of antennas, and more particularly, to an antenna employing an electromagnetic reflector and a transverse electromagnetic feed mounted on an electrically conductive strut through which electromagnetic energy is carried between the strut and the reflector.

During the past several years there has been growing interest in developing ultra wide band (a bandwidth extending several octaves) radio frequency systems. A key element in an ultra wide band radio frequency system is the antenna which provides the transmission of electromagnetic energy and/or detection of return signals. Planar wide band antennas and ridged horn antennas are two type of antennas which have been used in wide band radio frequency systems.

Planar wide band antennas may be either of the spiral or sinuous type. In cases where the spiral arms are fed in antiphase to the center of the antenna, the spiral arm radiates energy in bidirectional beams perpendicular to the plane of the spiral. In many applications, bidirectional beams are not desired due to the generation of back lobe radiation. Therefore, spiral type planar wide band antennas typically employ back cavities so that they only generate unidirectional radiation. The construction of a spiral type planar antennas generally involves printing spirally shaped metal strips on one side of the substrate layer of the supporting substrate which is then inserted inside a metal cavity. This type of antenna is generally not suitable for high power applications because of the limitations of the dielectric breakdown properties of the supporting materials. Moreover, since a spiral type of planar antenna does not use a parabolic reflector, this type of antenna has a very low gain.

A sinuous type of planar antenna is very similar to a spiral type of planar antenna, except that the spiral strips are replaced by a sinuous pattern of metal strips formed on the sides of the substrate. The major drawbacks for this type of antenna are low power handling capabilities and low antenna gain.

The ridged horn antenna is another type of broadband antenna that is often used in communications applications. A ridged horn antenna is generally composed of two flanges which carry electromagnetic energy from the signal source to the illumination area of the ridge horn antenna. An impedance transformer is normally inserted between the two flanges to match the input impedance of the antenna to the source. For low frequencies (generally less than 1 GHz), this type of antenna is very lengthy, and difficult to construct. The antenna gain of the ridged horn antenna typically is higher than that of the spiral and sinuous types of planar antennas. However, the gain of the ridged horn antenna is generally less than most directional narrow beam antennas, making the ridged horn antenna unsuitable for applications which require high gain.

A reflector is often used to achieve a required level of gain for a highly directional antenna. A reflector antenna generally includes a reflector dish and a feed horn which may exist in several configurations. Two well known configurations of a feed horn antenna are the rectangular horn and cylindrical horn. In such configurations, the feed horn is a radiator mounted at the focal point of a reflector. Electromagnetic energy radiates from the feed horn to the metallic surface of the reflector dish from which it is directed into free-space. Mechanical struts support the feed horn at the focal point of the reflector, but have no electromagnetic function.

DESCRIPTION OF THE DRAWINGS

Throughout the above FIGS. and accompanying text, like components are referenced using like reference numbers.

SUMMARY OF THE INVENTION

A broadband antenna is disclosed which comprises an electromagnetic reflector; a transverse electromagnetic transmission carrier which includes a first electrically conductive strut having a first electrical impedance which is mounted in electrical contact with the reflector, and a second electrically conductive strut having a second electrical impedance substantially equal to the first electrical impedance, and which is mounted in electrical contact with the reflector; and a transverse electromagnetic feed having a first electrical conductor mounted in electrical contact with the first strut, and a second electrical conductor electrically isolated from the first electrical conductor and electrically coupled to the second strut.

An important advantage of the present invention is that it provides an antenna which has a very wide bandwidth of multidecades. The excellent performance achievable with the invention is due to the use of a novel combination of a transverse electromagnetic transmission carrier and an electromagnetic feed mounted to the carrier. The carrier is generally implemented in the form of struts which conduct electromagnetic energy between the electromagnetic feed and the reflector dish, whereas in prior art feed horn antennas, the struts merely serve to physically support the feed horn off of the reflector. Because of the wide bandwidth characteristics of the invention, RF communication systems may employ one antenna embodying various features of the present invention instead of multiple antennas which would otherwise be necessary to cover the same bandwidth. Furthermore, the invention provides high gain across the frequency band. This antenna is expected to find wide application in communications application.

DESCRIPTION OF THE PREFERRED EMBODIMENT

Figure 1:
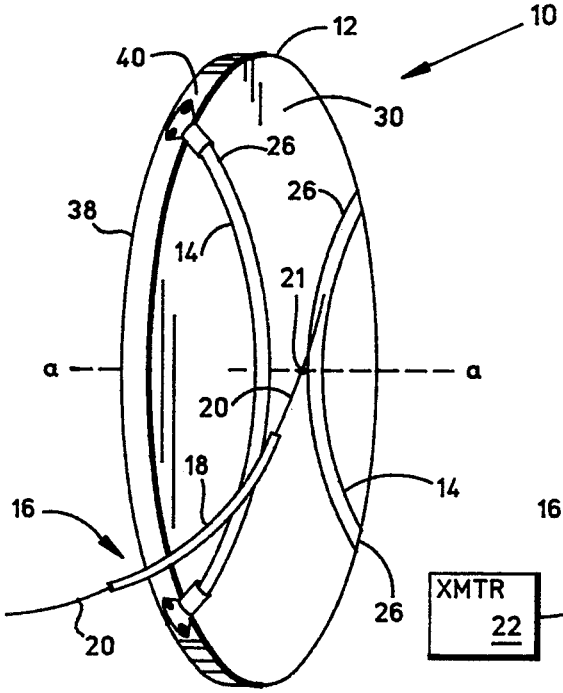
FIG. 1 is a perspective view of a hybrid orthogonal transverse electromagnetic fed reflector antenna embodying various features of the present invention.
Figure 2:
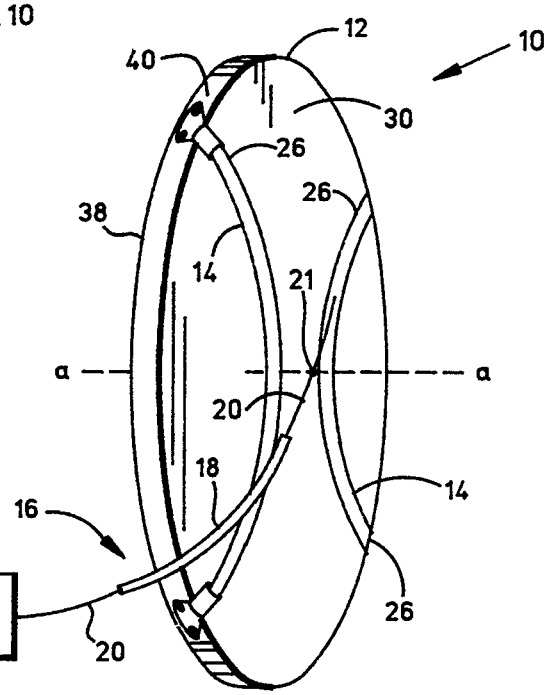
FIG. 2 shows the antenna of FIG. 1 operably coupled to a transmitter.
Figure 3:
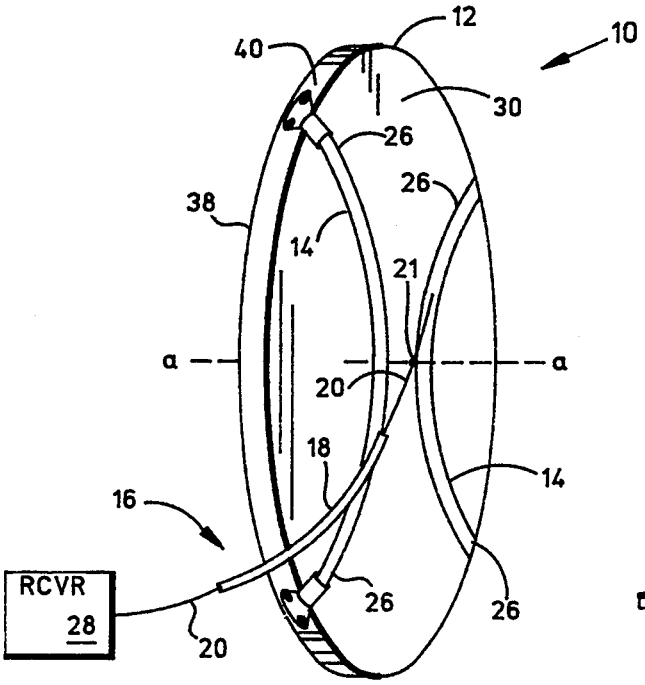
FIG. 3 shows the antenna of FIG. 1 operably coupled to a receiver.

Referring to FIG. 1, there is shown an orthogonal transverse electromagnetic fed reflector antenna 10 embodying various features of the present invention. The antenna 10 includes an electromagnetic reflector 12 on which a plurality of impedance balanced transverse electromagnetic (TEM) transmission carrier, or struts 14 are mounted, and an electromagnetic feed 16 mounted to one of the struts 14. The electromagnetic feed 16 preferably is implemented as a coaxial cable 16 which includes two electrical conductors separated by a dielectric: an outer conductor 18, and an inner conductor 20, as shown in FIG. 1. The outer conductor 18 is supported by and in electrical contact with one of the struts 14. The inner electrical conductor 20, typically electrically "hot," is electrically connected to the other strut 14 and typically transects the focus region along the focal axis a—a of the antenna, where the focus region includes the focal point 21 of the reflector 12. However, there are some applications where it may be desirable for the inner connector 20 to intersect regions other than the focus region, depending on the shape of the radiation pattern desired from the antenna 10. The intersection of a section of the inner connector 20 and the focus region 21 usually provides the antenna 10 with the best gain and sidelobe rejection. The connection of the electrical conductor 20 to the other strut 14 is a transition region where electrical energy transitions from a form carried by the inner conductor 20 of the coaxial line to a form carried by the strut 14 of the balanced transmission line. The strut 14 in electrical contact with the inner conductor 20 conducts electromagnetic energy between the inner conductor 20 and the reflector 12. For example, when the antenna 10 is used to transmit electromagnetic radiation, electromagnetic energy generated by a radio frequency transmitter 22 is provided as an output to the inner conductor 20 and is conveyed via the strut 14 to the reflector 12 from which the electromagnetic energy radiates when the antenna 10 is used in a transmitting system. In applications where the antenna 10 is used to receive electromagnetic radiation from a distant electromagnetic source, not shown, the electromagnetic energy is collected by the reflector 12 and then is conducted via the strut 14 in contact with the inner conductor 20 to the input of a radio frequency receiver 28 connected to the inner conductor 20, as shown in FIG. 2.

Figure 4:
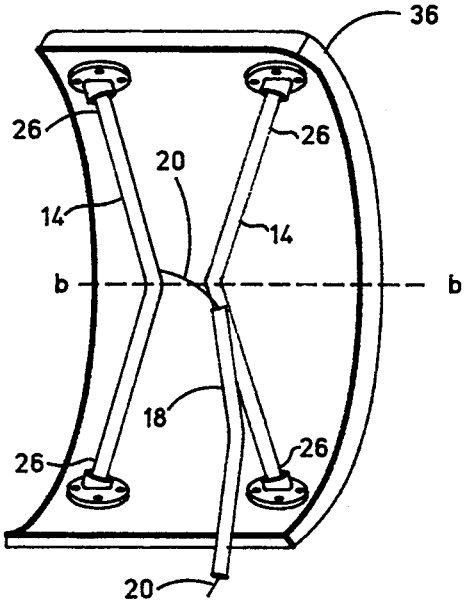
FIG. 4 shows an electromagnetic reflector having the shape of a section of a cylinder.

Referring to FIG. 1, the reflector 12 may be made of fiberglass and have a metallized coating, not shown, on its concave surface 30. By way of example, the reflector 12 may be shaped as a portion of a conical surface to shape the radiation pattern of the antenna 10. Such conical surfaces sections may, for example, include an ellipsoid, a paraboloid, and a spheroid. The reflector 12 may also be shaped as a section of a cylinder 36 having a focal axis b—b, as shown in FIG. 4. Referring again to FIG. 1, the convex surface 38 of the reflector 12 may be coated with an electromagnetic absorbent coating 40, such as RAM or RAS, which reduces or eliminates back lobe radiation.

Figure 5A:
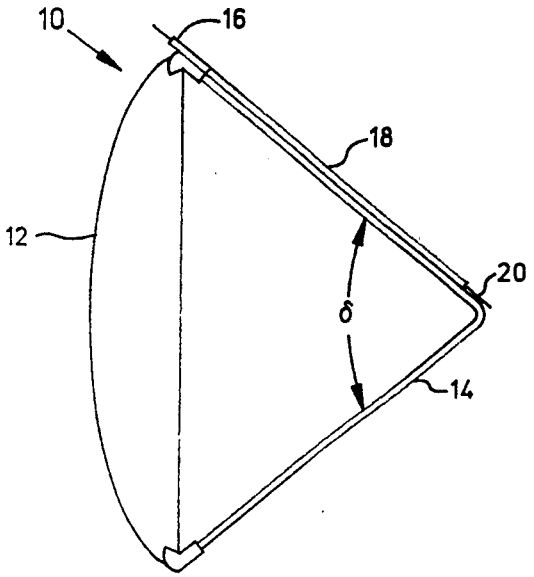
FIGS. 5A and 5B show an antenna embodying various features of the present invention which includes linearly shaped struts.
Figure 5B:
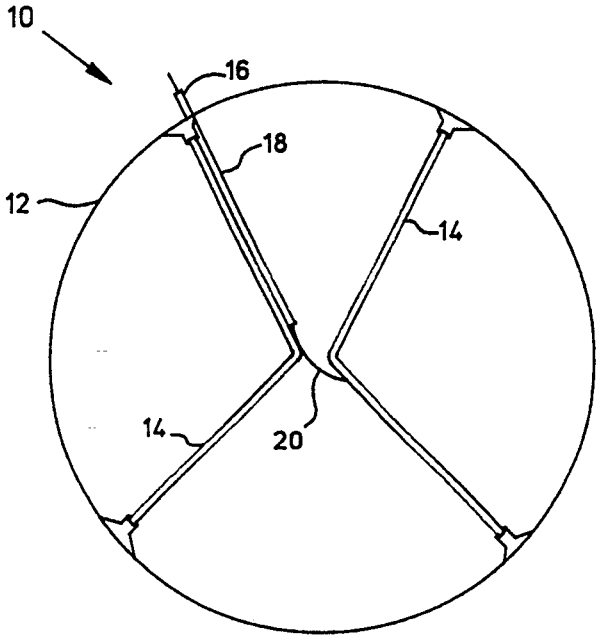
Figure 6A:
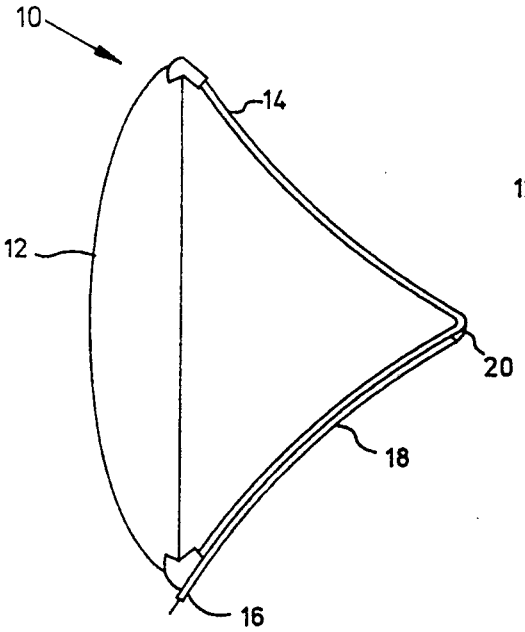
FIGS. 6A and 6B show an antenna embodying various features of the present invention which includes exponentially shaped struts where the inner conductor of the transverse electromagnetic feed substantially intersects the focal point of the reflector.
Figure 6B:
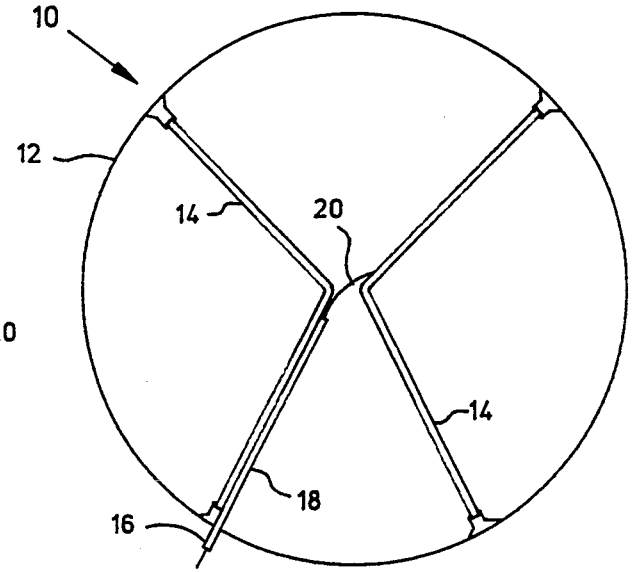
Figure 7A:
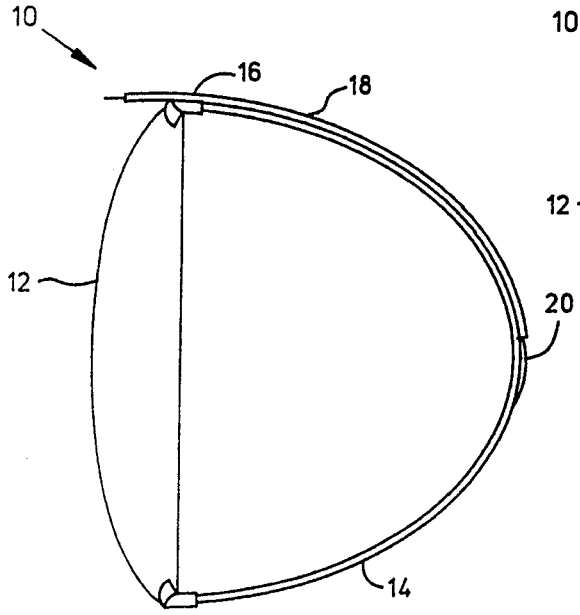
FIGS. 7A and 7B show an antenna embodying various features of the present invention which includes sinusoidally shaped struts where the inner conductor of the transverse electromagnetic feed substantially intersects the focal point of the reflector.
Figure 7B:
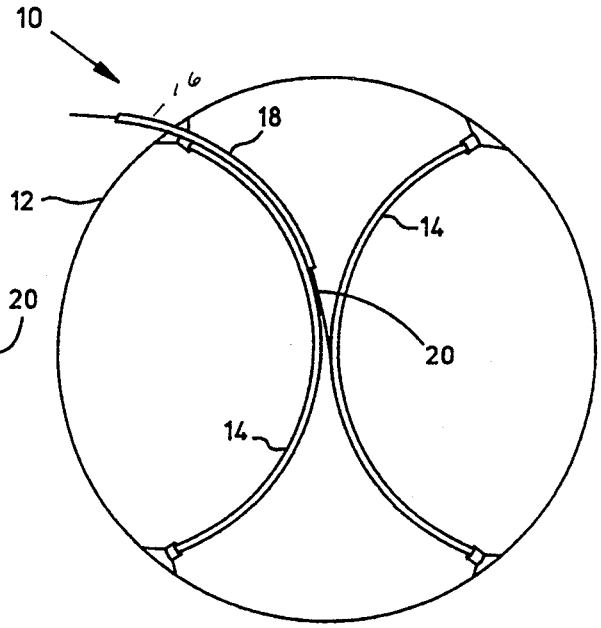
Figure 8:
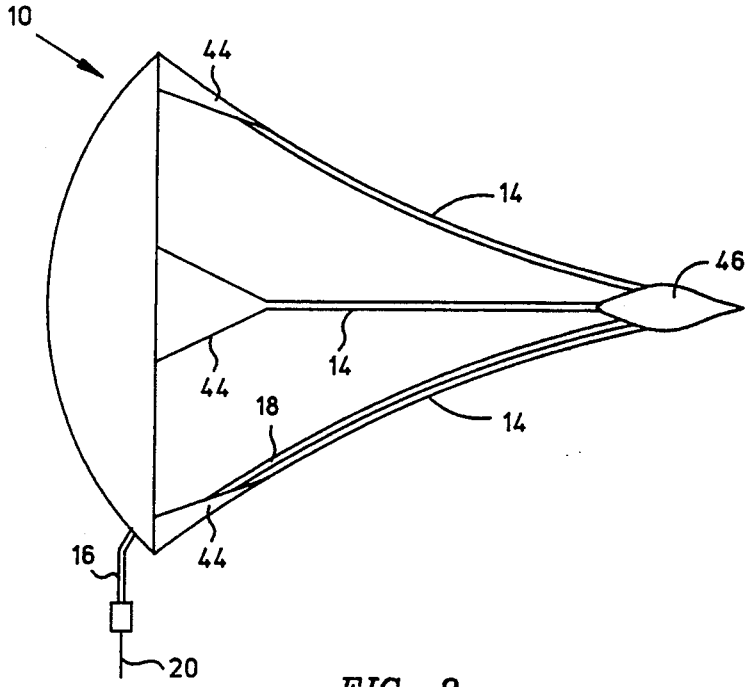
FIG. 8 shows a side elevation view of an example of the antenna of FIG. 1 which further includes low frequency and high frequency matching elements mounted to the struts.

Again referring to FIG. 1, the electrically conductive struts 14 may be fabricated from lengths of tubular or solid electrically conductive metal, such as aluminum, copper, brass, silver alloys, etc. Although the antenna 10 is shown to include two diametrically opposed struts 14, it is to be understood that the scope of the invention includes the use of any number of struts. Each strut 14 may be fabricated from a tubular, electrically conductive structure into an angularly shaped structure having two ends 26 which may be mounted at or near the periphery 40 of the reflector dish 12. In order to optimize impedance matching, the struts 14 are preferably mounted to the reflector dish so that they are diametrically opposed to each other, and so that the ends 26 of the struts 14 are separated by about 90° about the periphery 40 of the reflector 12 for applications in which the reflector dish 12 is circularly shaped with respect to a plane that is perpendicular to the focal axis a—a of the reflector dish. The struts 14 may be mounted to the reflector 12 by any suitable means well known by those of ordinary skill in the art, as for example, by riveting, adhesive bonding, or welding. The struts 14 are formed so as to extend from the side of the reflector 12 having the concave surface 30. The overall length of the struts 14 may be formed so as to have an exponential profile, as shown in FIGS. 6A and 6B, a sinusoidal profile, as shown in FIGS. 7A and 7B or a linear profile, as shown in FIGS. 5A and 5B. For best performance, the struts 14 should generally have no surface discontinuities which would alter their electrical impedance. Moreover, with reference to FIG. 8, the antenna 10 preferably includes low frequency matching elements 44 mounted to the struts 14 near the point of attachment of the struts to the reflector 12, and high frequency matching elements attached near the apex of the struts 14, as would well known by those of ordinary skill in the art of antenna design.

The two primary factors which determine the radiation characteristics of the antenna 10 are the F/D ratio of the reflector 12 and the flare angle, $\delta$, where F is the focal length of the reflector, D is the diameter of the reflector, and $\delta$ is the flare angle (See FIG. 5), defined as the angle between the two (linear) struts 14, as shown in FIG. 7.

Figure 9A:
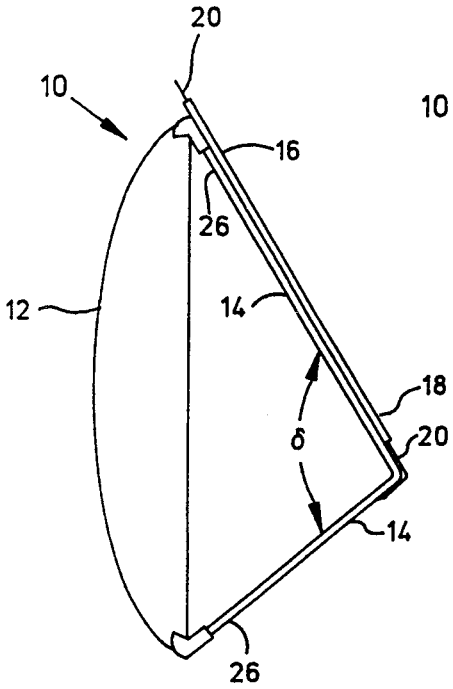
FIGS. 9A and 9B show an antenna embodying various features of the present invention which includes linearly shaped struts where the inner conductor of the transverse electromagnetic feed intersects a region offset from the focal point of the reflector.
Figure 9B:
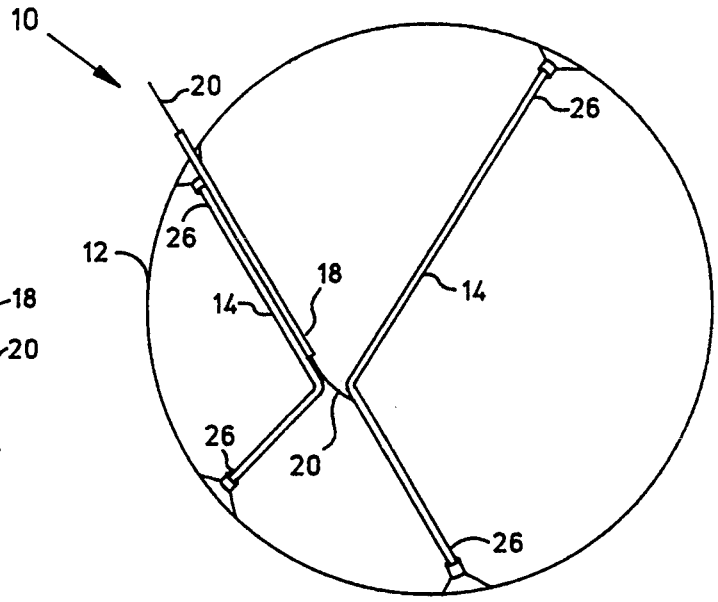

Obviously, many modifications and variations of the present invention are possible in light of the above teachings. For example, it may be desirable for the inner connector 20 to intersect regions other than the focus region 21, as shown in FIGS. 9A and 9B, in applications where attainment of the best gain and/or sidelobe rejection are not primary performance objectives of the antenna. It is therefore to be understood that within the scope of the appended claims, the invention may be practiced otherwise than as specifically described.

I claim:

1. A broadband antenna, comprising:

an electromagnetic reflector having a focal point;

a transverse electromagnetic transmission carrier which includes:

a first electrically conductive strut having a first electrical impedance and mounted in electrical contact with said reflector; and a second electrically conductive strut having a second electrical impedance substantially equal to said first electrical impedance, and which is mounted in electrical contact with said reflector; and a transverse electromagnetic feed having a first electrical conductor mounted in electrical contact with said first strut, and a second electrical conductor intersecting said focal point and electrically coupled to said second strut.

2. The antenna of claim 1 wherein:

said reflector has a focal point along a focal axis;

said first strut is a structure having two ends which are mounted proximal to the periphery of said reflector at locations separated from each other by about 90 degrees with respect to a plane which intersects said focal axis at substantially 90°; and said second strut is a structure having two ends which are mounted proximal to the periphery of said reflector at locations separated from each other and from said ends of said first strut by about 90 degrees with respect to said plane.

3. The antenna of claim 1 wherein said first and second struts have an exponentially curved profile.

4. The antenna of claim 3 further including a low frequency matching element mounted to each of said first and second struts.

5. The antenna of claim 3 further including a high frequency matching element mounted to each of said first and second struts.

6. The antenna of claim 1 wherein said first and second struts have a sinusoidally curved profile.

7. The antenna of claim 6 further including a low frequency matching element mounted to each of said first and second struts.

8. The antenna of claim 6 further including a high frequency matching element mounted to each of said first and second struts.

9. The antenna of claim 1 wherein said first and second struts have a linearly shaped profile.

10. The antenna of claim 9 further including a low frequency matching element mounted to each of said first and second struts.

11. The antenna of claim 9 further including a high frequency matching element mounted to each of said first and second struts.

12. The antenna of claim 1 wherein said reflector is shaped as a section of a paraboloid.

13. The antenna of claim 1 wherein said reflector is shaped as a section of an ellipsoid.

14. The antenna of claim 1 wherein said reflector is shaped as a section of a cylinder.

15. The antenna of claim 1 wherein said reflector has a convex surface and which further includes an electromagnetic radiation absorbent material mounted to said convex surface.

16. A broadband radio frequency transmission system, comprising:

an electromagnetic reflector having a focal point;

a transverse electromagnetic transmission carrier including:

a first electrically conductive strut having a first electrical impedance and mounted in electrical contact with said reflector; and a second electrically conductive strut having a second electrical impedance substantially equal to said first electrical impedance, and which is mounted in electrical contact with said reflector;

a transverse electromagnetic feed having a first electrical conductor mounted in electrical contact with said first strut, and a second electrical conductor intersecting said focal point and electrically coupled to said second strut; and a radio frequency transmitter having an output operably coupled to said transverse electromagnetic feed.

17. A broadband radio frequency receiving system, comprising:

an electromagnetic reflector having a focal point;

a transverse electromagnetic feed transmission carrier including:

a first electrically conductive strut having a first electrical impedance and mounted in electrical contact with said reflector; and a second electrically conductive strut having a second electrical impedance substantially equal to said first electrical impedance, and which is mounted in electrical contact with said reflector;

a transverse electromagnetic feed having a first electrical conductor mounted in electrical contact with said first strut, and a second electrical conductor intersecting said focal point and electrically coupled to said second strut; and a radio frequency receiver having an input operably coupled to said transverse electromagnetic feed.

* * * * *